United States Patent [19]

Kahelin

[11] Patent Number: 4,705,014

[45] Date of Patent: Nov. 10, 1987

[54] VARIABLE SPEED SINGLE-WHEELED BALL PROPELLING MACHINE

[76] Inventor: Edward W. Kahelin, 3921 Kitten Cir., Huntington Beach, Calif. 92649

[21] Appl. No.: 687,482

[22] Filed: Dec. 27, 1984

Related U.S. Application Data

[63] Continuation of Ser. No. 397,768, Jul. 13, 1982, abandoned.

[51] Int. Cl.[4] ..... F41B 15/00

[52] U.S. Cl. ..... 124/1; 124/6; 124/81

[58] Field of Search ..... 124/78, 1, 81, 124/83, 41 R, 6; 273/26 D, 179 R, 182 R, 201

[56] References Cited

U.S. PATENT DOCUMENTS

| | | | |
|---|---|---|---|
| Re. 30,703 | 8/1981 | Paulson et al. | 124/81 X |
| 1,211,738 | 1/1917 | Marty | 124/1 |
| 2,189,288 | 2/1940 | Heyer | 474/14 |
| 2,705,945 | 4/1955 | Cavalier | 124/6 |
| 3,538,900 | 11/1970 | Samuels | 124/78 |
| 3,604,409 | 9/1971 | Doeg | 273/26 D X |
| 3,641,704 | 2/1972 | Sims et al. | 124/78 X |
| 3,878,827 | 4/1975 | Newgarden | 124/81 |
| 4,323,047 | 4/1982 | McIntosh et al. | 124/81 |
| 4,423,717 | 1/1984 | Kahelin | 124/78 |

*Primary Examiner*—Richard J. Apley
*Assistant Examiner*—J. Welsh
*Attorney, Agent, or Firm*—George W. Finch

[57] ABSTRACT

An improved apparatus for propelling balls such as softballs and baseballs with accurate and predetermined spins, speeds and placements, which includes a spinning wheel opposed by a guide having an inner diameter slightly larger than the diameter of the ball to be thrown. The guide positions the ball properly against the wheel and continues such until the ball is released from the wheel. The speed of the wheel is controlled by a constant speed motor which drives the wheel through use of a belt, a fixed pulley connected to the wheel and variable diameter pulley connected to the motor. The motor is controllably pivoted for movement toward and away from the wheel which changes the tension in the belt and causes the variable diameter pulley to change diameters and drive the wheel at the different controlled speeds.

3 Claims, 6 Drawing Figures

VARIABLE SPEED SINGLE-WHEELED BALL PROPELLING MACHINE

This is a continuation of copending patent application Ser. No. 397,768, filed July 13, 1982, now abandoned.

BACKGROUND OF THE INVENTION

Machines for throwing balls which accelerate the ball through the use of two opposed spinning wheels, such as shown in WILSON, U.S. Pat. No. 2,729,206, DOEG, U.S. Pat. No. 2,918,918, YARUR, et al., U.S. Pat. No. 3,913,552, HALSTEAD, U.S. Pat. No. 3,724,437 and BETTEN, U.S. Pat. No. 3,811,421, are relatively expensive due to the increasing cost of the special tires involved in such machines and the need for special transmission or multiple motors. Single-wheel machines, that is machines which accelerate the ball by using a single wheel opposed by some sort of chute, usually having a rub strip therein, are more economical to manufacture but suffer from poor accuracy and the inability to accelerate a ball to as fast a speed as the two-wheel machines. There are instances where, for example, the single-wheel ball-throwing machine is to be used to provide softball batting practice, slow pitch softball batting practice or baseball practice for up to 12 year old individuals where this inability to highly accelerate a ball is not of major disadvantage. However, for such applications, the accuracy of the throw becomes more important since the participants are usually less skilled in avoiding an errant throw. In some single-wheel machines, complex control mechanisms have been employed to attempt to improve the accuracy of the machines. Heretofore these attempts have not been particularly successful. In addition, complex control mechanisms are expensive which eliminates the cost advantage that would otherwise exist between such single-wheel and the double-wheel machines.

SUMMARY OF THE PRESENT INVENTION

The present invention is a single-wheel machine. The wheel preferrably includes a tire that is sold for such purpose under the Goodyear or Armstrong trademarks. These tires have been commercially available for a number of years and are similar to treadless trailer tires.

The wheel includes a fixed diameter pulley. Rotational energy is transferred to the wheel from a constant speed motor by means of a belt which extends about the wheel pulley and a variable diameter, spring loaded pulley mounted on the motor. The variable diameter pulley is responsive to tension in the belt to change the drive ratio between the constant speed motor and the wheel. To enable such change of tension, the motor is pivotally mounted and includes a lever and lever restraint for predetermined tensioning of the belt and therefore predetermined speed of ball throw.

The entire motor and wheel assembly is mounted pivotally for rotation in what is normally a vertical plane about the center gravity of the assembly so that the initial vertical angle of ball ejection can be adjusted. When used in commercial establishments the speed and angle once adjusted, is fixed so that a batter wishing to hit different kinds of pitches must move from batting cage to batting cage although the machine in any batting cage can be quickly adjusted to throw a pitch in any desired position or at different speeds. For the portable team embodiment, removable legs can be provided rather than the permanent mounting usually provided in commerical establishments, and the speed and angle can be adjusted between pitches if such is desired.

The consistent throwing ability of the present machine is governed essentially by two factors. The speed of the wheel and the orientation of a ball guide chute which opposes the wheel and remains in contact with a thrown ball during the time that the wheel is also in contact with the ball. The chute adjacent the wheel is concave semicircular in shape having an inner diameter just larger than the nominal diameter of the ball to be thrown. This is important, as it has been found that smaller diameters tend to impart a random sideways rotation to the ball which makes its flight unpredictable whereas in larger chutes, the ball tends to rattle from side to side so that its horizontal ejection angle is unpredictable. It also is important that the chute remain in contact with the ball until the wheel releases the ball since shorter chutes result in vertical dispersion depending upon the coefficient friction of the ball within the chute and longer chutes tend to deflect the ball randomly downward. The chute themselves are removable from the machines so that chutes adapted to the size of the ball to be propelled can be quickly installed or replaced on the machine.

It is therefore an object of the present invention to provide an economic and accurate ball-throwing machine which is suitable for fast pitch and slow pitch softball and baseball where the extreme velocities required to simulate major league pitching are not required.

Another object is to provide a single-wheel ball-throwing machine which does not require high maintenance rub strips or complex control mechanisms.

Another object is to provide a single-wheel ball-throwing machine whose drive speed can be changed, whose speed changing mechanism is simple, which requires very little maintenance and can be operated with safety.

Another object is to provide a portable ball-propelling machine which is light enough to be handled easily by one person and which can be transported in a normal size automobile.

These and other objects and advantages of the present invention will become apparent to those skilled in the art after considering the following detailed specification which covers a preferred embodiment of the present invention in conjunction with the accompanying drawing:

DETAILED DESCRIPTION OF THE PRESENT EMBODIMENT

Figure 1:
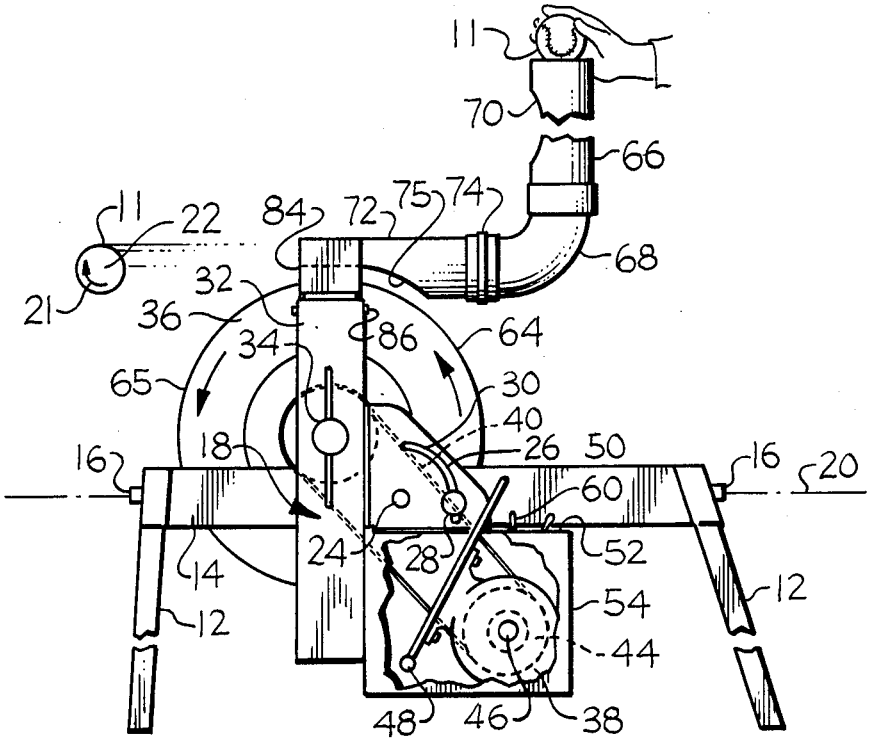
FIG. 1 is a side view of the present invention propelling balls.

Referring to the drawing more particulary by reference numbers, number 10 in FIG. 1 refers to a variable single-wheel ball-propelling machine constructed according to the present invention. The machine 10, as shown, is designed to throw pitches at various speeds and at different initial elevational angles but with the ball spin axis of a fast ball, so that a stable accurate flight of the ball 11 is maintained throughout its flight. The machine 10 includes legs 12 which may be of the portable nature or fixed with respect to the ground and a cross-frame member 14 which may include optional pivots 16 connecting to the legs 12 so that the ball-propelling portion 18 of the machine 10 can be rotated about the axis 20 formed between the pivots 16, for changing the initial spin 21 of the ball 11 from the rotation shown in FIG. 1 to one in which its spin axis 22 is canted with respect to the horizontal which generally causes the ball 11 to curve. The pivots 16 mounting the legs 12 to the horizontal cross-frame member 14 are aligned with the approximate center of gravity 23 of the ball propelling portion 18.

The ball-propelling portion 18 is mounted pivotally at its approximate center gravity 23 to the cross frame 14 by means of a pivot bolt 24. The pivoting of the portion 18 is fixedly controlled by means of a slot 26, a friction knob 28 attached to the cross frame member 14 and the periphery 30 adjacent the slot 26 which is engaged by the friction knob 28 when tightened down to retain the portion 18 at a desired angle. The angle shown in FIG. 1 is approximately horizontal.

Figure 2:
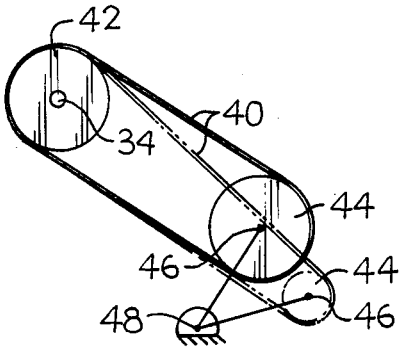
FIG. 2 is a diagrammatic view showing the speed changing mechanism employed on the present machine.
Figure 3:
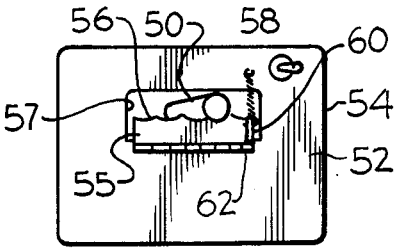
FIG. 3 is an enlarged detailed view looking down on the speed control means for the wheel.

The portion 18 includes an upright member 32 which supports the axle 34 for the ball-propelling wheel 36. The wheel 36 is connected for rotation to a constant speed motor 38 by means of a drive belt 40 which extends between a fixed diameter pulley 42 attached to the wheel 36 and a variable diameter pulley 44 attached to the drive shaft 46 of the motor 38. The variable diameter pulley 44 is of the commercially available, spring loaded type which responds to increasing belt tension by expanding its two halves thus reducing the drive diameter applied to the belt 40. The motor 38 is movable about a pivot 48. Movement of the motor 38 about the pivot 48 and the effect it causes is shown diagrammatically in FIG. 2. This pivoting motion is controlled by a lever 50 which extends out of the top 52 of the motor covering box 54. The top 52 is shown in FIG. 3. The lever 50 and therefore the pivoted position of the motor 38 is retained in predetermined locations by a hinge member 55 having a toothed edge 56 adapted to engage the lever 50 at various positions thereof. The hinge member 55 is biased downward toward a slot 57 up through which the lever 50 extends by means of a tension spring 58 connected between the top 52 and an upwardly extending arm 60 on the hinge member 55 so that the hinge member 55 can be rotated out of the way about its pivot 62 when it is desired to change the position of the lever 50 and thus the speed of the wheel 36. Since the motor 38 is of the constant speed type, the simple adjustment provided by the movement of the motor 38 enables the speed of the wheel 36 to be finely regulated.

The ball 11 to be propelled is guided against the outer surface 64 of a pneumatic tire 65 of the wheel 36 by means of a chute 66 which includes a ball insertion elbow portion 68 having a cutout 70 therein so that the batter can observe the ball 11 passing therethrough and a wheel opposition portion 72. The portions 68 and 72 are releasably coupled by a clamp 74 so that the relative angle therebetween can be adjusted for movement of the machine 10 to different throwing angles about the axis 20. The opposition portion 72 in operation is shown in detail in FIGS. 4, 5 and 6.

Figure 4:
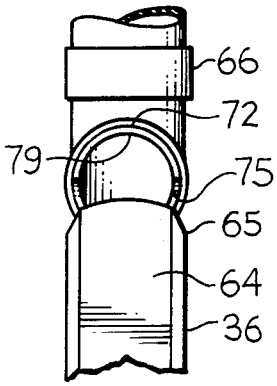
FIG. 4 is a front detailed view of a portion of the ball propelling wheel and guide chute.
Figure 5:
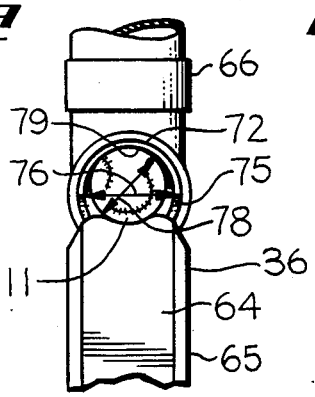
FIG. 5 is a view similar to FIG. 4 showing the chute in use and in relation to a ball being propelled therethrough.
Figure 6:
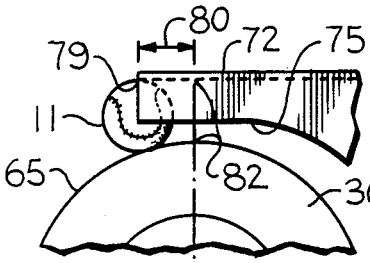
FIG. 6 is a detailed side view of a portion of the chute and wheel showing the relationship of a propelled ball at the instant it is released from the wheel and chute.

As can be seen in FIG. 4, the outer surface 64 of the tire 65 expands outwardly due to centrifical force exerted thereon when the wheel 36 is spinning. This changes with speed but is constant for a constant speed. When a ball 11 is passed through the chute 66, it comes in contact with the outer surface 64 of the tire 65 and depresses the same slightly as shown in FIG. 5. The wheel opposition portion 72 includes a cutout 75 adjacent the wheel 36 so that only about 180° of what was a 360° chute remains when the ball 11 comes in full contact with the surface 64. The inner diameter 76 of the chute 72 is only slightly larger than the diameter 78 of the ball 11, the difference being exaggerated in FIG. 5 for clarity. For example, for baseballs and softballs, the diameter 78 of the ball 11 and the inner diameter 76 of the chute 72 are about 0.2 inches different. This causes the ball 11 to remain centered on the outer tire surface 64 in contact with the inner top surface 79 of the chute 66 without undesirably rubbing along the sides of the chute 72 which could impart undesirable side spins to the ball 11 as it leaves the chute 66. The length 80 of the chute 72 beyond the points of maximum contact 82 where the chute 66 is parallel with the wheel surface 64 is also critical to accurate ball throwing. The proper relationship is shown in FIG. 6 where the length 80 is such that the ball 11 is released from contact with the tire outer surface 64 at the same time it releases from the inner top surface 79 of the chute 66. This assures that the ball 11 will be accurately thrown ball after ball without readjustment of the machine 10, increasing the safety of the machine especially when employed with inexperienced batters.

When it is desired to adapt the machine 10 to balls of different diameter, the chute 66 along with its support 84 are removed from the upright framed member 32. This is easily accomplished because the support 84 is releasably connected to the member 32 by bolts 86. A new support with a chute of the proper length and inner diameter is then substituted.

Thus there has been shown and described a novel single-wheel ball-propelling device which fulfills all the objects and advantages sought therefore. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

What is claimed is:

1. A machine for propelling balls such as softballs and baseballs in a predetermined direction with a spin axis including:

an axle mounted to a support frame;

a ball to be propelled having a predetermined diameter;

a pneumatic tire mounted for rotation on said axle having an outer surface adapted to make contact with said ball to be propelled;

means operatively connected to said pneumatic tire to spin said pneumatic tire with a predetermined rotation about said axle; and a ball chute connected to said support frame and positioned at a right angle to said axle adjacent and in alignment with said pneumatic tire to guide said ball to be propelled into contact with said pneumatic tire and to guide said ball to be propelled while in contact with said pneumatic tire, said ball chute having:

a central position where said chute is at a minimum distance from said outer surface;

an outer end; and an inner surface with a linear section generally parallel to a plane tangential to the upper surface of said pneumatic tire and which is relatively rigid with respect to said pneumatic tire outer surface, said inner surface extending from said central position to said outer end, said inner surface having:

a cross-section which is semi-circular with a diameter that is slightly larger than said predetermined diameter of said ball to be propelled, said inner surface facing said pneumatic tire outer surface and being fixedly spaced therefrom at said outer end a distance essentially equal to said predetermined diameter of said ball, whereby said ball to be propelled is released from contact with said pneumatic tire outer surface and said chute inner surface of said predetermined diameter essentially simultaneously as said ball to be propelled is propelled in said predetermined direction.

2. The machine as defined in claim 1 wherein said ball chute includes a cutout of about 180° adjacent said wheel outer surface in which the ball to be propelled makes contact with said wheel outer surface and said chute inner surface.

3. A machine for propelling balls such as softballs and baseballs in a predetermined direction spinning about an axis including:

an axle mounted to a support frame;

a ball to be propelled having a predetermined diameter;

a pneumatic tire mounted for rotation on said axle having an outer surface adapted to make contact with said ball to be propelled;

means operatively connected to said pneumatic tire to spin said pneumatic tire with a predetermined rotation about said axle; and a ball chute connected to said support frame and positioned at a right angle to said axle adjacent and in alignment with said pneumatic tire to guide said ball to be propelled into contact with said pneumatic tire and to guide said ball to be propelled while in contact with said pneumatic tire, said ball chute having:

a point defining with said outer surface a minimum spacing between said ball chute and said outer surface;

an outer end; and an inner surface which is rigid with respect to said pneumatic outer surface extending from said point to said outer end in a linear path, said inner surface having:

a cross-section generally perpendicular to the predetermined direction, which inner surface cross-section has the shape of at least a portion of a circle with a diameter that is slightly larger than said predetermined diameter of said ball to be propelled, said inner surface facing said pneumatic tire outer surface and being spaced therefrom at said outer end a distance essentially equal to said predetermined diameter of said ball, whereby said ball to be propelled compresses said pneumatic tire a maximum amount when positioned in contact with said point and then reduces compression of said pneumatic tire and stays in continuous contact with said chute inner surface until said ball to be propelled is released from contact with said pneumatic tire outer surface and said chute inner surface essentially simultaneously as said ball to be propelled is propelled in said predetermined direction, said ball chute further including:

a cutout of about 180° adjacent said pneumatic tire outer surface in which the ball to be propelled makes contact with said pneumatic tire outer surface and said chute inner surface.

* * * * *